US006702603B2

(12) United States Patent
Wu

(10) Patent No.: US 6,702,603 B2
(45) Date of Patent: Mar. 9, 2004

(54) ELECTRICAL CONNECTOR HAVING ENGAGING DEVICE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 36 days.

(21) Appl. No.: 10/236,597

(22) Filed: Sep. 5, 2002

(65) Prior Publication Data

US 2004/0023546 A1 Feb. 5, 2004

Related U.S. Application Data

(63) Continuation-in-part of application No. 10/209,553, filed on Jul. 30, 2002.

(51) Int. Cl.[7] ..... H01R 13/627
(52) U.S. Cl. ..... 439/352; 439/357
(58) Field of Search ..... 439/352, 350, 439/351, 353–358, 607, 610

(56) References Cited

U.S. PATENT DOCUMENTS 3,548,455 A * 12/1970 Ezurre ..... 439/352
4,634,204 A * 1/1987 Detter et al. ..... 439/347
5,564,939 A 10/1996 Maitani et al.
5,634,809 A * 6/1997 Hirai ..... 439/352
5,951,316 A * 9/1999 Kawano et al. ..... 439/352
6,394,842 B1 * 5/2002 Sakurai et al. ..... 439/607

* cited by examiner

*Primary Examiner*—Hien Vu
(74) *Attorney, Agent, or Firm*—Wei Te Chung

(57) ABSTRACT

An electrical connector (1) includes an main housing and a subassembly (60) assembled into the main housing and an engaging device (40). The main housing includes a base (10), and a cover (20) assembled to the base. The subassembly includes a plurality of terminals (64) received therein. The engaging device includes a pull tab mounted on the base, a pair of latch springs (70) cooperating with the pull tab and a pair of fasteners (50) mounted on the main housing. When the electrical connector is adapted to mate with the complementary connector, the pull tab and the fasteners are driven whereby the latch springs and the fasteners engage with the complementary connector.

10 Claims, 8 Drawing Sheets

ELECTRICAL CONNECTOR HAVING ENGAGING DEVICE

CROSS-REFERENCES TO RELATED APPLICATIONS

This application is a continuation-in-part of U.S. patent application Ser. No. 10/209,553 filed on Jul. 30, 2002 and entitled "ELECTRICAL CONNECTOR HAVING A LATCH MECHANISM". This application is also related to a copending U.S. Pat. application with an unknown serial number and entitled "ELECTRICAL CONNECTOR HAVING IMPROVED LATCH MECHANISM", which are assigned to the common assignee and which are hereby fully incorporated by reference.

BACKGROUND OF THE INVENTION

1. Field of the Invention

The present invention relates to an electrical connector, and particularly to an electrical connector having engaging device for engaging with and releasing a mated complementary connector.

2. Description of Prior Art

Referring to U.S. Pat. No. 5,564,939, a conventional electrical connector disclosed in the patent has a pair of latch springs 22 and 22A respectively attached on opposite sides of a housing 21 of the connector. An operating member 23 has a pair of latch releasing cams 23-4 located below angled portions 22-4 of the latch springs 22, 22A. When an operator pulls a pull tab 23-8 of the operating member 23 backwardly, the latch releasing cams 23-4 exert outward forces on the angled portions 22-4 and U-shaped claws 22-1 slip out to release a mated complementary connector. Because the operating member 23 and the latch spring 22, 22A are positioned outside of the housing 21, they are very easy to be damaged or misoperation when a force is exerted thereon. Furthermore, repeated operations may affect the precise alignment between the connector and the mated complementary connector. In addition, because the construction of the latch springs is very thin, it is easy to be damaged when the connector mates with the mated complementary connector. Therefore, an electrical connector with an improved engaging device is desired to resolve the above-mentioned problems or disadvantages.

SUMMARY OF THE INVENTION

It is an objective of the present invention to provide an electrical connector having an improved engaging device assembled therein for firmly engaging with and releasing a mated complementary connector.

In order to achieve the object above-mentioned, an electrical connector in accordance with the present invention An electrical connector includes an main housing and a subassembly assembled into the main housing and an engaging device. The main housing includes a base, and a cover assembled to the base. The subassembly includes a plurality of terminals received therein. The engaging device includes a pull tab mounted on the base, a pair of latch springs cooperating with the pull tab and a pair of fasteners mounted on the main housing. When the electrical connector is adapted to mate with the complementary connector, the pull tab and the fasteners are driven whereby the latch springs and the fasteners engage with the complementary connector.

Other objects, advantages and novel features of the invention will become more apparent from the following detailed description when taken in conjunction with the accompanying drawings.

DETAILED DESCRIPTION OF THE INVENTION

Figure 1:
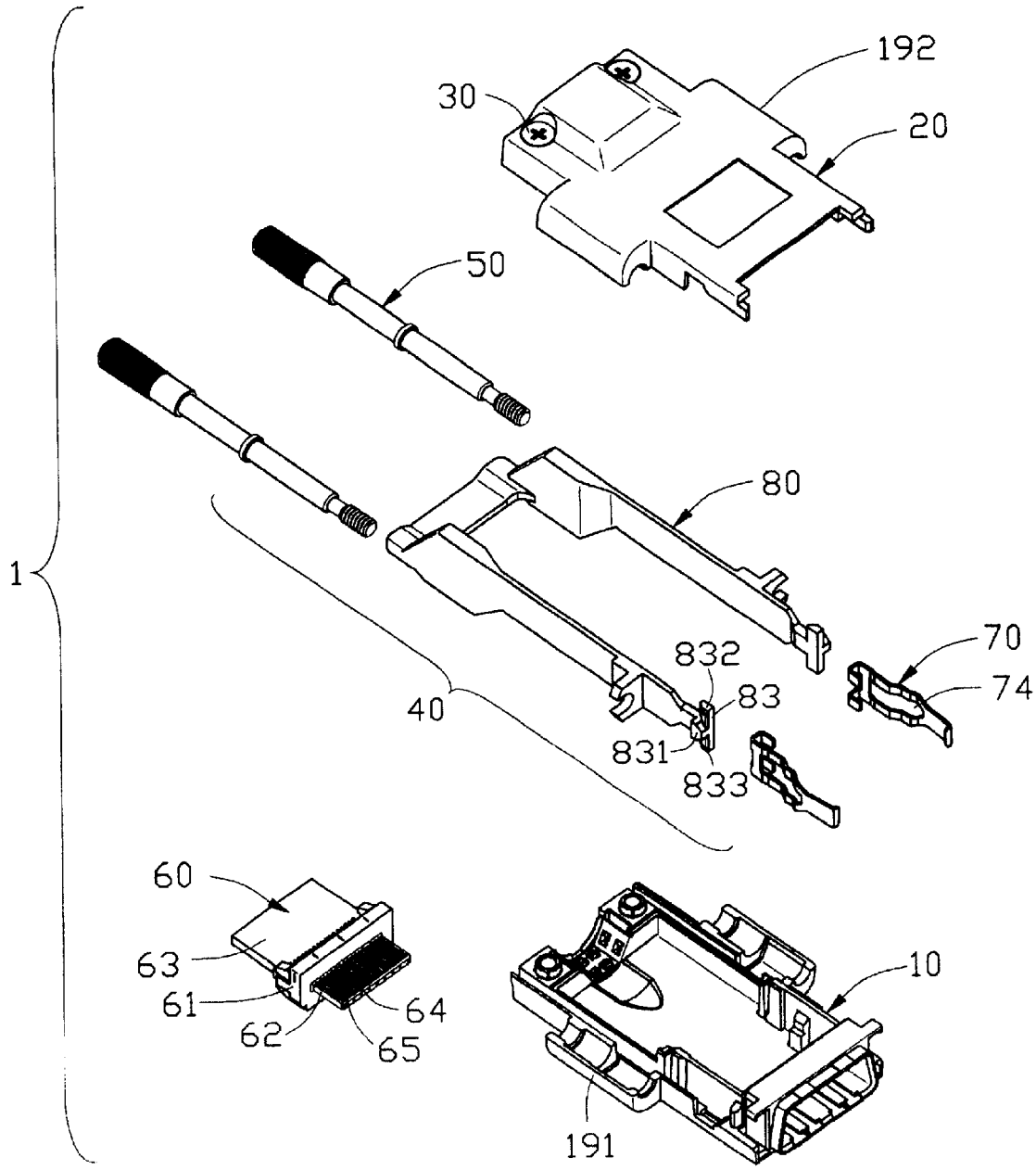
FIG. 1 is an exploded perspective view of an electrical connector in accordance with the present invention.

Referring to FIG. 1, an electrical connector 1 in accordance with the present invention comprises a main housing which includes a base 10 and a cover 20, a pair of screws 30 for securing the cover 20 on the base 10, a subassembly 60, and an engaging device 40.

Figure 2:
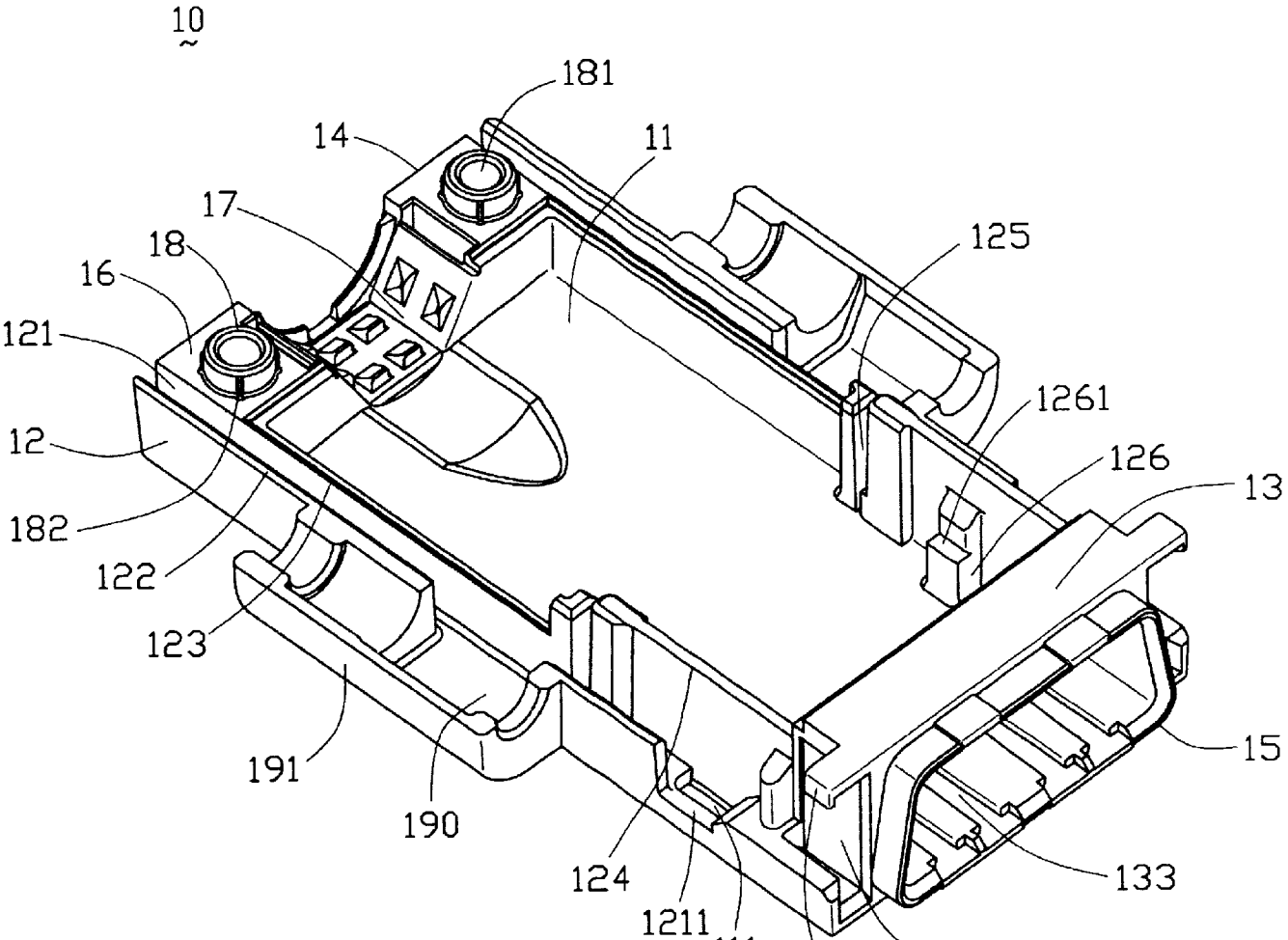
FIG. 2 is an enlarged perspective view of a base of the connector shown in FIG. 1.

The main housing is formed by die casting metallic material, for example, aluminum alloy. Referring to FIG. 2, the base 10 comprises a base plate 11 and a pair of sidewalls 12 upwardly extending from opposite lateral sides of the base plate 11. Each sidewall 12 defines an elongated channel 121 from a rear end 14 toward a front end 15 of the base 10 and through a top engaging face 16 thereof. Each sidewall 12 is divided into an outer wall 122 and an inner wall 123 by the channel 121. The inner walls 123 each have a higher shoulder portion 124 adjacent to the front end 15. The shoulder portions 124 each define a vertical slit 125 at a rear end thereof. The outer walls 122 each define a cutout 1211 adjacent to the front end 15. A pair of blocks 126 is formed on inner sides of the shoulder portions 124 of the inner walls 123. Each block 126 comprises a step portion 1261. The base plate 11 defines a pair of grooves 111 each being located between the shoulder portion 124 of a corresponding inner wall 123 and a corresponding cutout 1211. A mating frame 13 is formed at the front end 15 of the base 10. The mating frame 13 defines an opening 133 through the front end 15. A pair of engaging ears 131 is formed on opposite sides of a top of the mating frame 13 and extends laterally. A pair of engaging spaces 132 is defined in opposite sides of the mating frame 13 and between the engaging ears 131 and the base plate 11. The base 10 has a first substantially semicircular opening 17 at the rear end 14. A pair of posts 18 protrudes upwardly from the engaging face 16, located respectively at opposite sides of the first opening 17. Each post 18 defines a screw hole 181 therein and has four ribs 182 on a circumferential periphery thereof.

Figure 3:
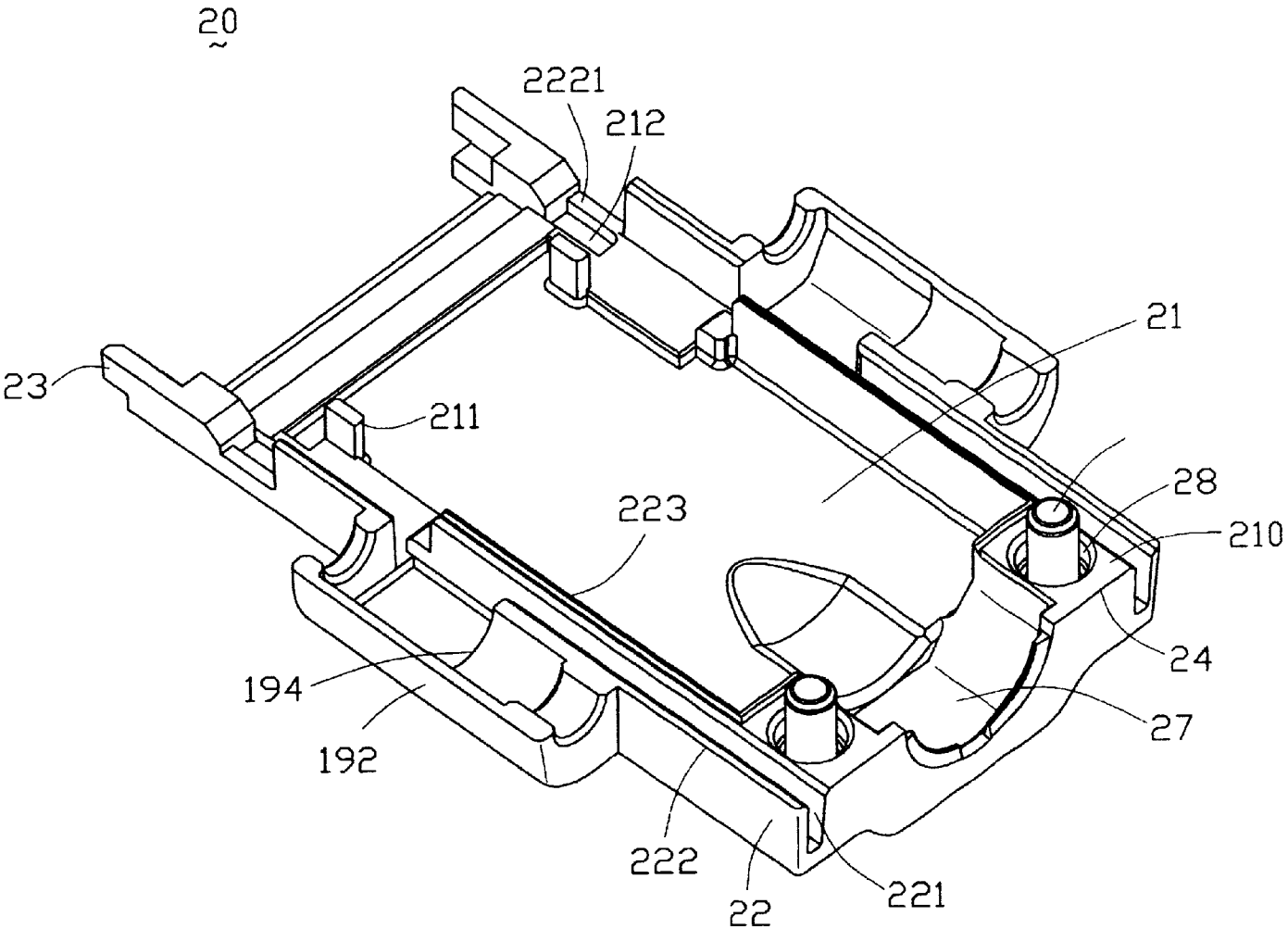
FIG. 3 is an enlarged perspective view of a cover of the connector shown in FIG. 1.

Referring to FIG. 3, the cover 20 comprises a cover plate 21 and a pair of sidewalls 22 downwardly extending from opposite lateral sides of the cover plate 21. Each sidewall 22 defines an elongated channel 221 corresponding to the channel 121 of the base 10. Each sidewall 22 is divided into an outer wall 222 and an inner wall 223 by the channel 221. A pair of blocks 211 extends downwardly from the cover plate 21 corresponding to the blocks 126. A pair of grooves 212, corresponding to the grooves 111 in the base 10, is defined in the cover plate 21 in inner sides of a pair of cutouts 2221 which is corresponding to the cutouts 1211 in the base 10. A pair of projections 23 extends forwardly from opposite sides of a front end the cover plate 21. A semicircular second opening 27 is defined in a rear end 24 of the cover plate 21 corresponding to the first opening 17 of the base 10. A pair of holes 28 is defined in opposite sides of the second opening 27. Each hole 28 has a diameter generally equal to an outer diameter of each of the posts 18. A pair of limbs 19 projects sidewardly from opposite sides of the main housing. Each limb 19 comprises a lower part 191 extending from one outer wall 122 of the base and an upper part 192 extending from one outer wall 222 of the cover 20. Each limb 19 defines a receiving space 190 together by the upper and lower parts 192 and 191.

Figure 4:
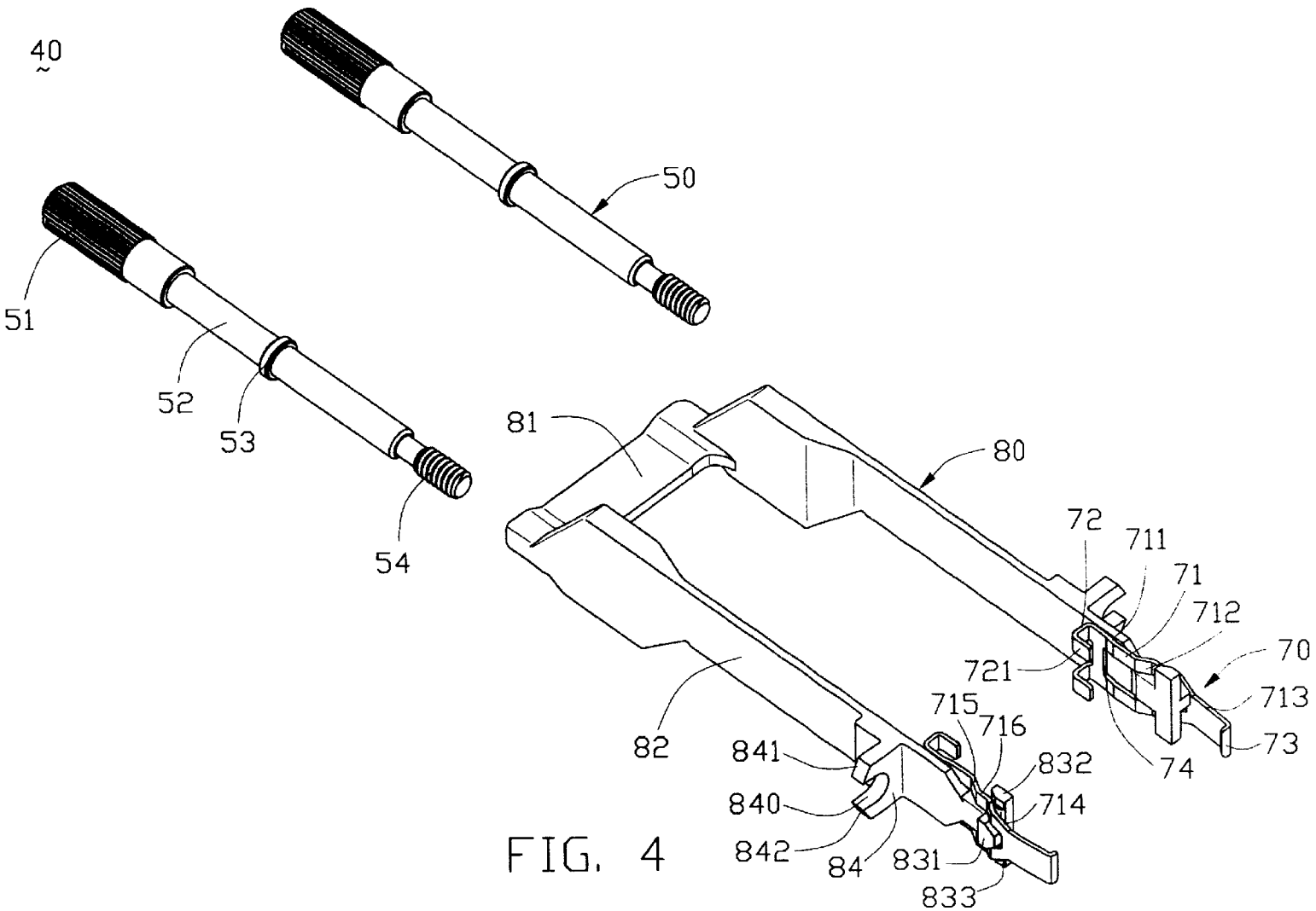
FIG. 4 is an enlarged perspective view of an engaging device of the connector shown in FIG. 1.

Referring to FIGS. 1 and 4, the engaging device 40 comprises a pair of elongate fasteners 50, a pair of latch springs 70 and a pull tab 80. The pull tab 80 comprises an operation portion 81 locating outside the main housing, a pair of arms 82 extending forwardly from opposite sides of the operation portion 81, and a pair of latch releasing portions 83 formed at front ends of the arms 82, respectively. Each latch releasing portion 83 has upper and lower tip ends 832, 833, and a protrusion 831 protruding outwardly from an outside face thereof. A pair of position block 84 projects sidewardly from sides of opposite arms 82. Each position block 84 comprises an upper portion 841, a lower portion 842 and a semicircular opening 840 defined between the upper portion 841 and the lower portion 842.

Each of the latch springs 70 is formed by stamping a metal sheet and has a body portion 71, a U-shaped claw portion 72 formed at a rear end of the body portion 71, and an L-shaped claw portion 73 formed at a front end of the body portion 71. An elongated cutout 74 is defined in the body portion 71 in a front to rear direction. The body portion 71 comprises a rear portion 711, a middle portion 712, and a front portion 713 extending inwardly from the middle portion 712. The middle portion 712 comprises a front slope portion 714, a rear slope portion 715, and an intermediate portion 716 between the front and rear slope portions 714, 715.

Each elongated fastener 50 has an operation end 51 at one end thereof, a fixing end 54 at the other end thereof, and a bar 52 locating between the operation end 51 and the fixing end 54. The bar 52 has a retention member 53 protruding outwardly from an outer surface thereof in a radial direction. The fixing end 54 has external threads on a rearmost end thereof.

The subassembly 60 is disclosed in the cross-reference applications in detail. The subassembly 60 comprises an insulating body 61, a tongue portion 62 extending forwardly from the body 61, a printed circuit board (PCB) 63 assembled to a rear side of the body 61. A plurality of passageways 65 is defined in upper and lower surfaces of the tongue portion 62. A plurality of terminals 64 is received in the passageways 65 of the tongue portion 62 and extends through the body 61 to electrically connect the PCB 63.

Figure 5:
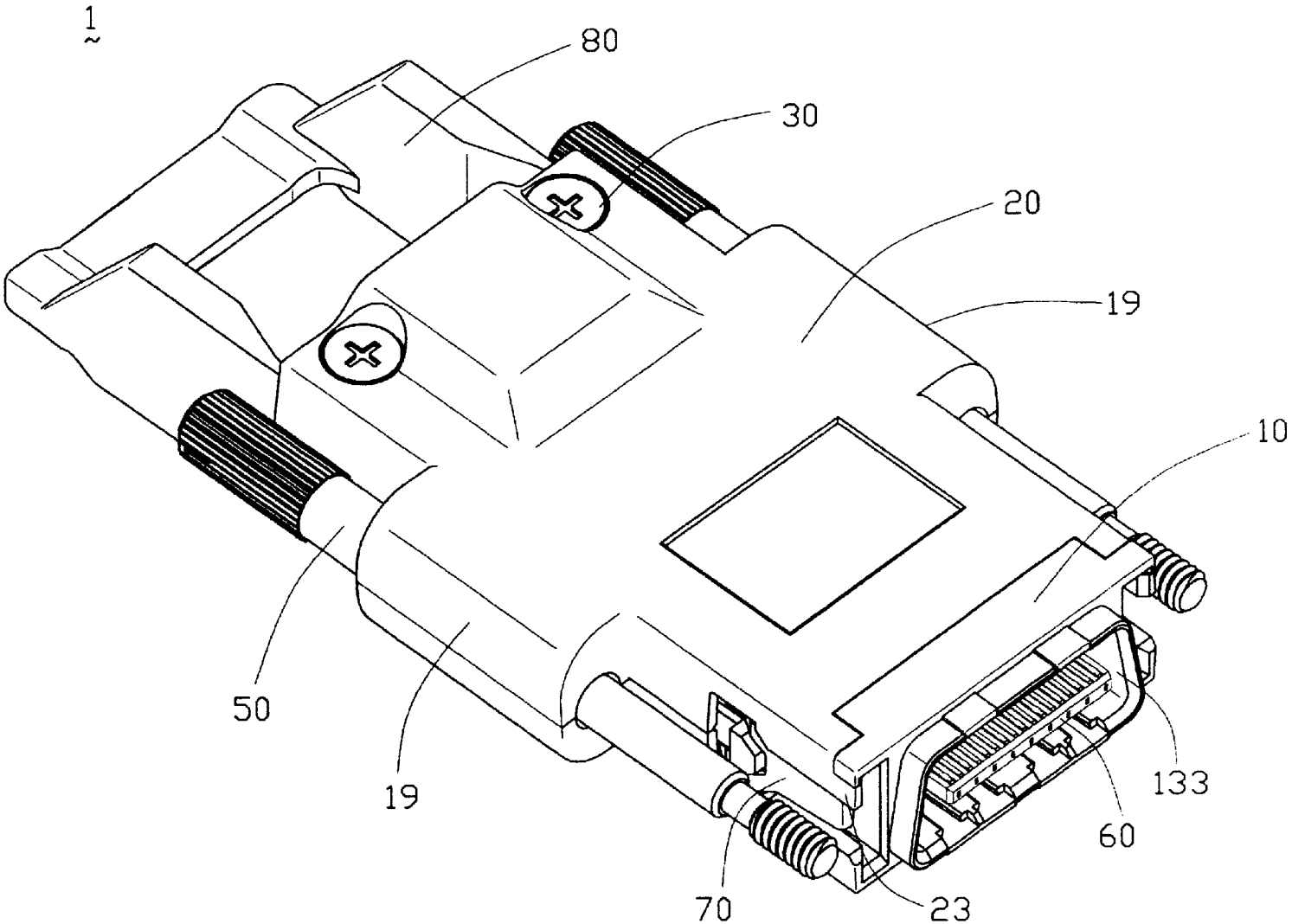
FIG. 5 is an enlarged assembled view of the electrical connector shown in FIG. 1.
Figure 6:
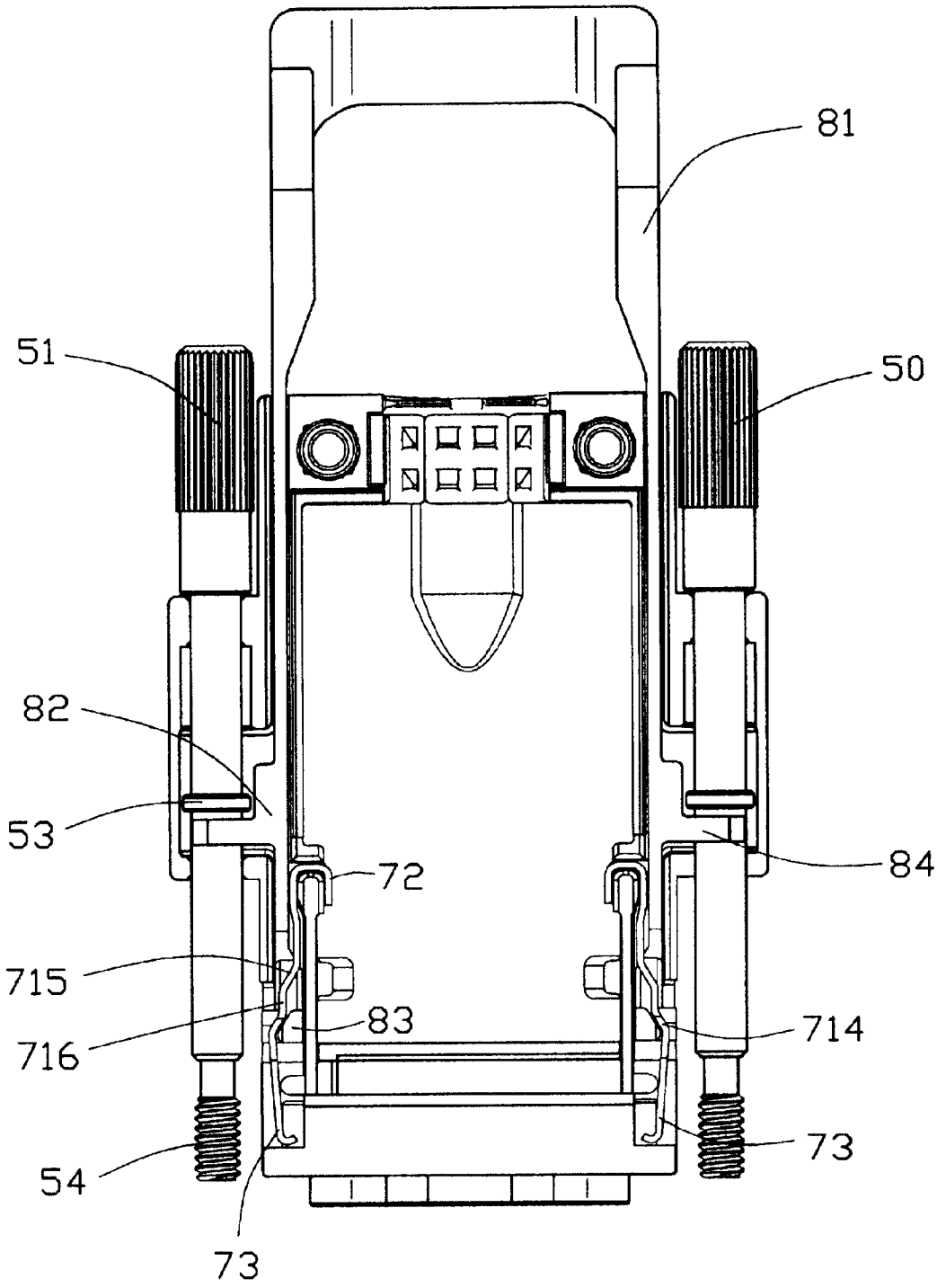
FIG. 6 is a top view of the connector of FIG. 5, showing the engaging device in an engaging position with the cover and a subassembly being removed.

Referring to FIGS. 5–6, in assembly, the subassembly 60 is assembled to the base 10 with the tongue portion 62 received into the opening 133. The PCB 63 is received in the base 10 between the two sidewalls 12. Two latch springs 70 are respectively assembled to the pull tab 80 by extending the protrusions 831 into the cutouts 74 from inner faces of the latch springs 70, whereby the latch releasing portions 83 engage with the inner faces of the latch springs 70, respectively. The latch releasing portions 83 are positioned at inner sides of the front portions 713. Then, the latch springs 70 together with the pull tab 80 are assembled to the base 10. The arms 82 are inserted into the channels 121 with the operation portion 81 located outside of the rear portion 14 of the base 10. The U-shaped claw portions 72 are received into the slits 125 and engaged with the shoulder portions 124 to secure the latch springs 70 to the base 10. The L-shaped claw portions 73 extend into the engaging spaces 132 for latching with a complementary connector (not shown). The lower tip ends 833 of the latch releasing portions 83 are placed in the grooves 111 with the protrusions 831 extending into the cutouts 1211. The fasteners 50 are assembled into the limbs 19 via extending through the semicircular openings 840 of the pull tab 80, while the bars are received in the receiving spaces 190 with the retention members 53 locating behind the position blocks 84 of the pull tab 80. The cover 20 is assembled to the base 10 by placing the projections 23 beneath the pair of engaging ears 131. Then a rear portion of the cover 20 is rotated downwardly about the pair of engaging ears 131 until a bottom face of the cover 20 intimately abuts the top engaging face 16 of the base 10. Upper portions of the arms 82 are received in the channels 221 and the upper tip ends 832 of the latch releasing portions 83 are received into the grooves 212 of the cover 20. The blocks 211 abut a top face of the PCB 63 above the step portions 1261 of the blocks 126 to secure the PCB 63 in position. The posts 18 are received into the holes 28 with the four ribs 182 engaging with inner surfaces of the holes 28. The first and second openings 17 and 27 together form a cable receiving opening for extension of a cable (not shown) therethrough. Finally, the screws 30 are screwed into the screw holes 181 to securely fasten the cover 20 and the base 10 together, whereby the electrical connector 1 in accordance with the present invention is obtained An operation of the electrical connector 1 in introduced below.

Referring to FIG. 6, when the electrical connector 1 of the present invention is mated with the complementary connector (not shown), the operation ends 51 of the faseteners 50 are ratable forwardly driven, so that external threads of the fixing ends 54 fully engage with nut portions of the complementary connector, and the latch releasing portions 83 of the pull tab 80 abut against the front slope portions 714 of the latch springs 70. Therefore, the L-shaped claw portions 73 clamp corresponding engaging portions of the complementary connector (not shown). When the connector is fully mated with the complementary connector (not shown), the operation ends 51 of the fasteners 50 abut against rear surfaces of the limbs 19.

Figure 7:
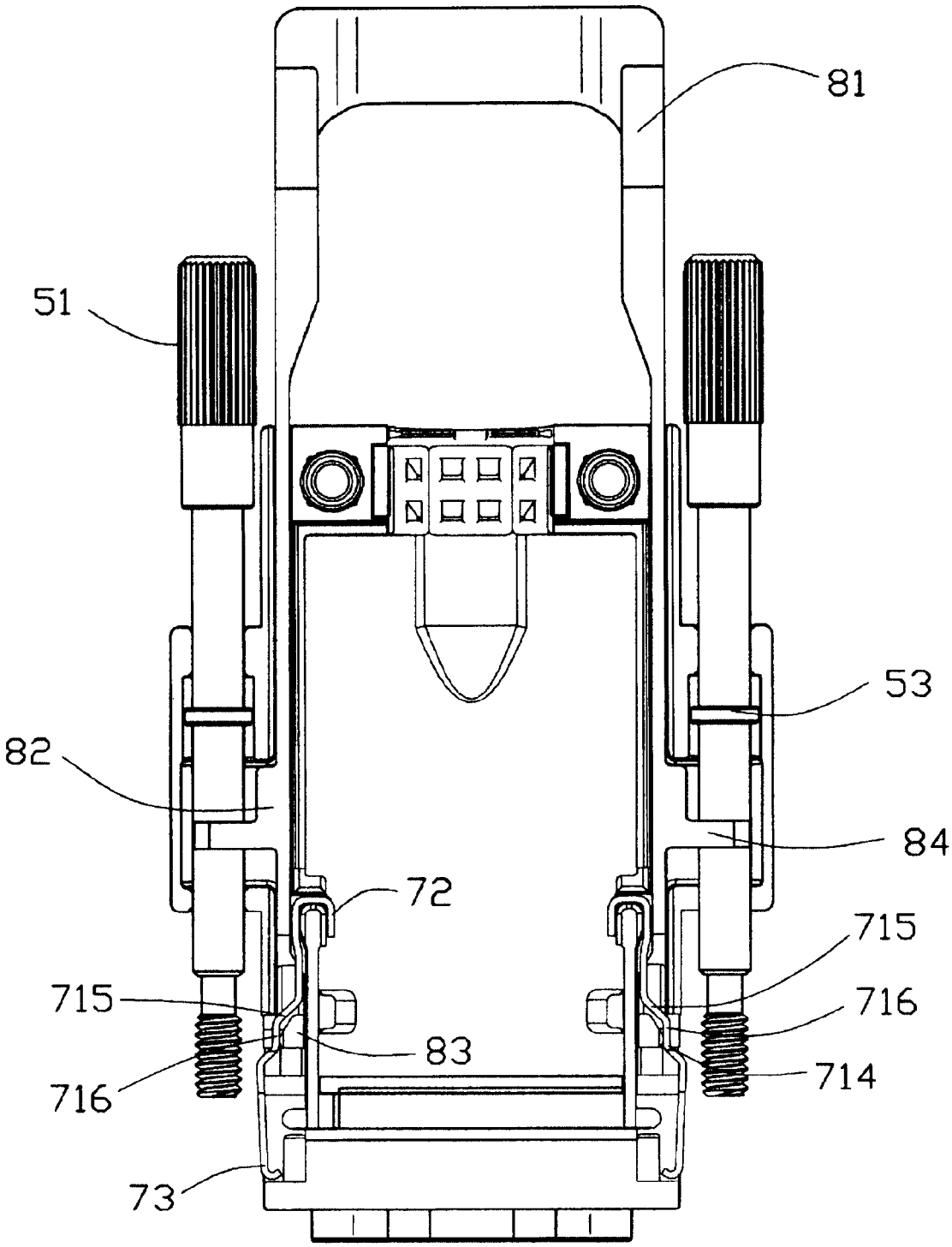
FIG. 7 is a view similar to FIG. 6, showing the engaging device without in the engaging position and a pair of fasteners without pushing a pull tab forwardly.

Referring to FIG. 7, the electrical connector 1 is separated from the complementary connector (not shown) by the following operation. Firstly, the operation ends 51 of the fasteners 50 are rotatably and rearwardly driven until the fixing ends 54 are disengaged with the nut portions of the complementary connector (not shown). An operator grips the operation portion 81 of the pull tab 80 and pulls it rearwards, the protrusions 831 of the pull tab slide in the cutouts 74 and the upper and lower tip ends 832, 833 slide in the grooves 111, 212 until moved rearwardly to rear ends of the grooves 111, 212 and engage with the cover 20 and the base 10, the latch releasing portions 83 come into contact with the intermediate portions 716, they exert an outward force on inner faces of the intermediate portions 716. The latch springs 70 are elastically deformed and the front portions 713 are pushed outwards in a lateral direction. Thus, the L-shaped claw portions 73 are driven to separate from the engaging portions of the complementary connector (not shown). Hence, the electrical connector 1 is pulled out from the complementary connector.

Figure 8:
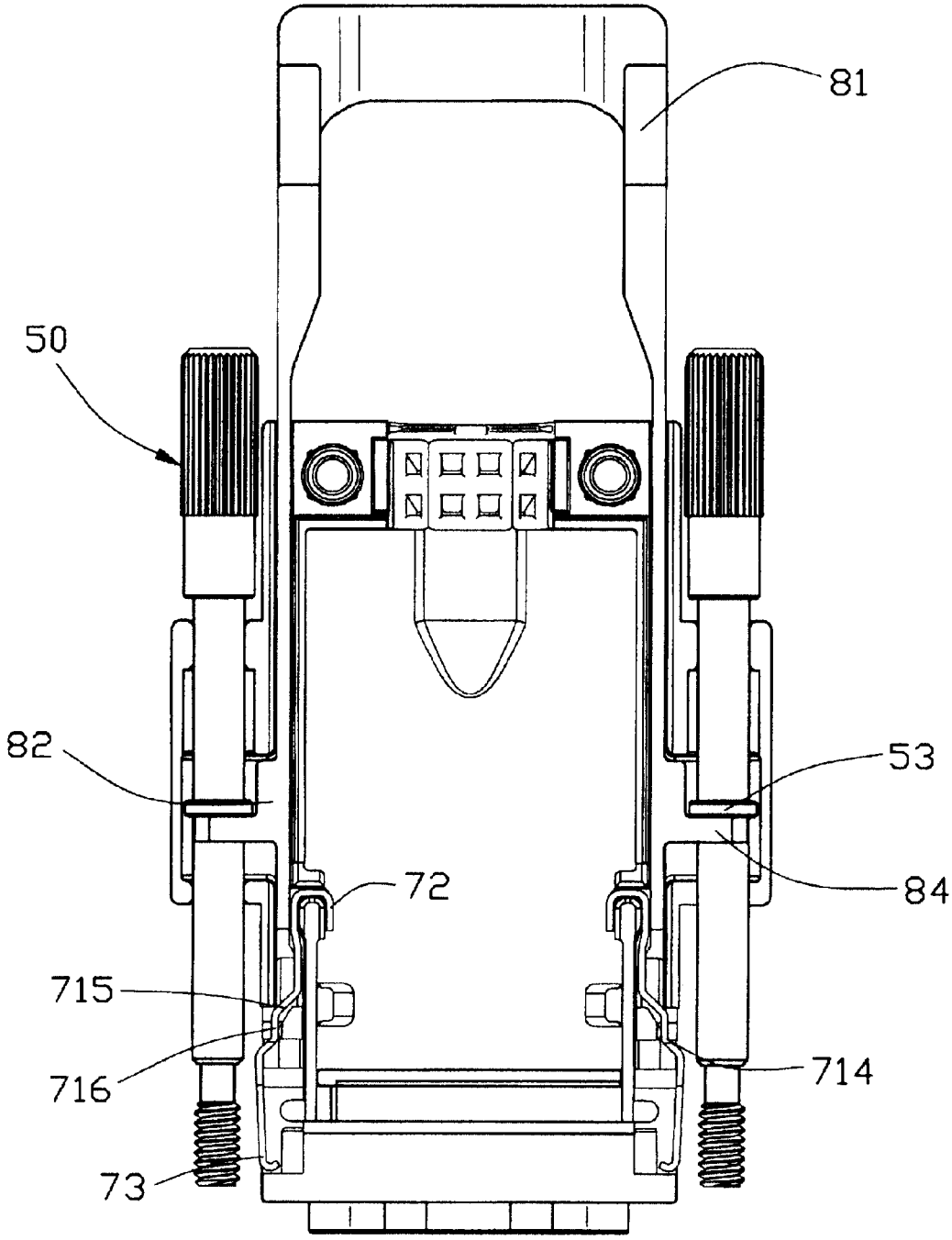
FIG. 8 is a view similar to FIG. 7, showing the engaging device without in the engaging position and the fasteners pushing the pull tab forwardly.

Referring to FIG. 8, before the connector mates with the complementary connector (not shown), the operator pushes the fasteners 50 forwardly, the retention members 53 push the position blocks 84 of the pull tab 80 forwardly and the upper tip ends 832 immediately leave the intermediate portions 716 to contact the front slope portions 714. A spring force of the sloping portions 713 of the latch springs 70 drives the L-shaped claw portions 73 resume to origin position, as shown in FIG. 6. Therefore the L-shaped claw portions 73 clamp the corresponding engaging portions of the complementary connector (not shown). Hence, the engaging device 40 provides the connector with a precise alignment with the complementary connector (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a complementary connector, comprising:

a main housing comprising a base and a cover assembled onto the base;

a subassembly assembled into the main housing and comprising a plurality of terminals received therein;

an engaging device comprising a pull tab mounted on the main housing, a pair of latch springs cooperating with the pull tab and a pair of fasteners mounted on the main housing; and wherein when the electrical connector is adapted to mate with the complementary connector, the pull tab and the fasteners are driven whereby the latch springs and the fasteners engage with the complementary connector; wherein a pair of limbs projects sidewardly from sidewalls of the main housing and a receiving space is defined in each limb to receive the fastener therein, wherein the pull tab has an operation portion and a pair of arms on opposed ends of the operation, a pair of position blocks projecting sidewardly from the arms and received in the receiving spaces of the limbs, when the fastener is driven, the position block is pushed by the fastener to motivate the pull tab resume to an original position; wherein the fastener comprises a fixing end at one end thereof for engaging with the complementary connector, an operation portion at the other end thereof and a retention member between the fixing portion and the operation portion, when the fastener is driven, the retention member pushes the position block to move in a back-to-front direction.

2. The electrical connector as described in claim 1, wherein the fixing end comprises external threads at rearmost end thereof.

3. The electrical connector as described in claim 2, wherein an opening is defined in the position block allowing the fastener extending therethrough.

4. The electrical connector as described in claim 5, wherein each latch spring has a first claw portion engaging with the base, a second claw portion adapted for securely engaging with the complementary connector when said complementary connector mates with the electrical connector, and a sloping portion between the first and second claw portions.

5. The electrical connector as described in claim 4, wherein each arm of the pull tab has a latch releasing portion at a free end thereof, the second claw engages with the corresponding latch releasing portion of the pull tab.

6. The electrical connector as described in claim 5, wherein each latch spring defines a cutout in the sloping portion, the latch releasing portion having a protrusion extending into the cutout from an inner face to an outer face of the sloping portion, so that the latch releasing portion contacts with the inner face of the sloping portion of the latch spring.

7. The electrical connector as described in claim 6, wherein the protrusion protrudes outwardly from an outside face of the latch releasing portion.

8. The electrical connector as described in claim 7, wherein the latch releasing portion has upper and lower tip ends, the cover and the base each defines a groove receiving the upper and lower tip ends of the latch releasing portion therein, the tip ends sliding rearwards in the grooves when the pull tab is pulled rearwards.

9. An electrical connector for mating with a complementary connector, comprising:

a main housing comprising a base and a cover assembled onto the base;

a plurality of terminals received in the main housing;

a latch spring assembled on the main housing;

a pull tab mounted on the main housing and including a latch releasing portion at a free end thereof;

a fastener mounted on the main housing;

engaging means arranged between the pull tab and the fastener for the pull tab being driven by the fastener; and wherein when the pull tab is pulled backwardly after the fastener is released, the latch releasing portion pushes the latch spring for separating from the complementary connector; when the fastener drives the pull tab forwards by the engaging means, the latch releasing portion makes the latch spring to resume to origin position for engaging with the complementary connector; wherein the engaging means comprises a position block formed on the pull tab and a retention member formed on the fastener; wherein the latch spring is deflectable in a lateral direction, and the pull tab and the fastener are slidable back and forth relative to the main housing in lengthwise direction perpendicular to said lateral direction; wherein a pair of limbs projects sidewardly from sidewalls of the main housing and a receiving space is defined in each limb to receive the fastener therein.

10. The electrical connector as described in claim 9, wherein the latch releasing portion laterally deflects the latch spring when the pull tab moves in lengthwise direction.

* * * * *